US005799594A

United States Patent [19]

Dernjatin et al.

[11] Patent Number: 5,799,594

[45] Date of Patent: Sep. 1, 1998

[54] METHOD AND APPARATUS FOR REDUCING NITROGEN OXIDE EMISSIONS FROM BURNING PULVERIZED FUEL

[75] Inventors: Pauli Dernjatin; Kati Savolainen, both of Helsinki; Juha Lepikko, Vantaa, all of Finland

[73] Assignee: IVO International Oy, Vantaa, Finland

[21] Appl. No.: 637,777

[22] PCT Filed: Nov. 8, 1993

[86] PCT No.: PCT/FI93/00461

§ 371 Date: May 2, 1996

§ 102(e) Date: May 2, 1996

[87] PCT Pub. No.: WO95/13502

PCT Pub. Date: May 18, 1995

[51] Int. Cl.[6] ..... F23D 1/00

[52] U.S. Cl. ..... 110/265; 110/347; 431/8

[58] Field of Search ..... 110/263, 264, 110/265, 347; 431/348, 8, 9

[56] References Cited

U.S. PATENT DOCUMENTS

| | | | |
|---|---|---|---|
| 4,422,391 | 12/1983 | Izuha et al. | 110/263 |
| 4,545,307 | 10/1985 | Morita et al. . | |
| 4,570,551 | 2/1986 | Derbidge et al. . | |
| 4,838,185 | 6/1989 | Flament | 110/263 |
| 4,907,962 | 3/1990 | Azuhata et al. . | |
| 4,915,619 | 4/1990 | LaRue | 110/265 |
| 5,020,454 | 6/1991 | Hellewell et al. . | |
| 5,263,426 | 11/1993 | Morita et al. | 110/265 |
| 5,431,114 | 7/1995 | Morita et al. | 110/265 |

FOREIGN PATENT DOCUMENTS

| | | |
|---|---|---|
| 2817295 | 11/1978 | Germany . |
| 320798 | 1/1991 | Germany . |
| 250775 A1 | 3/1985 | Russian Federation . |
| 605088 A2 | 12/1988 | Russian Federation . |

*Primary Examiner*—Henry A. Bennett
*Assistant Examiner*—Gregory A. Wilson

[57] ABSTRACT

Method for combusting pulverized fuels in a tangentially fired boiler and reducing emission of nitrogen oxides comprises steps of feeding a substantially air-deficient mixture of fuel and primary air through a fuel feeding pipe (1) tangentially into a furnace of the boiler in order to form a reducing flame (II) aNd blowing of at least one stream of combustion air into the furnace. The invEntion is based in that the stream of primary air and fuel is caused to recirculate and turbulate at the open end (2) of the fuel feeding pipe (1) by passing it through a flame holder (9) extending into the fuel feeding pipe (1), and the stream of combustion air is directed away from the primary air/fuel stream in order to prevent the combustion air to mix into the reducing flame (II).

20 Claims, 6 Drawing Sheets

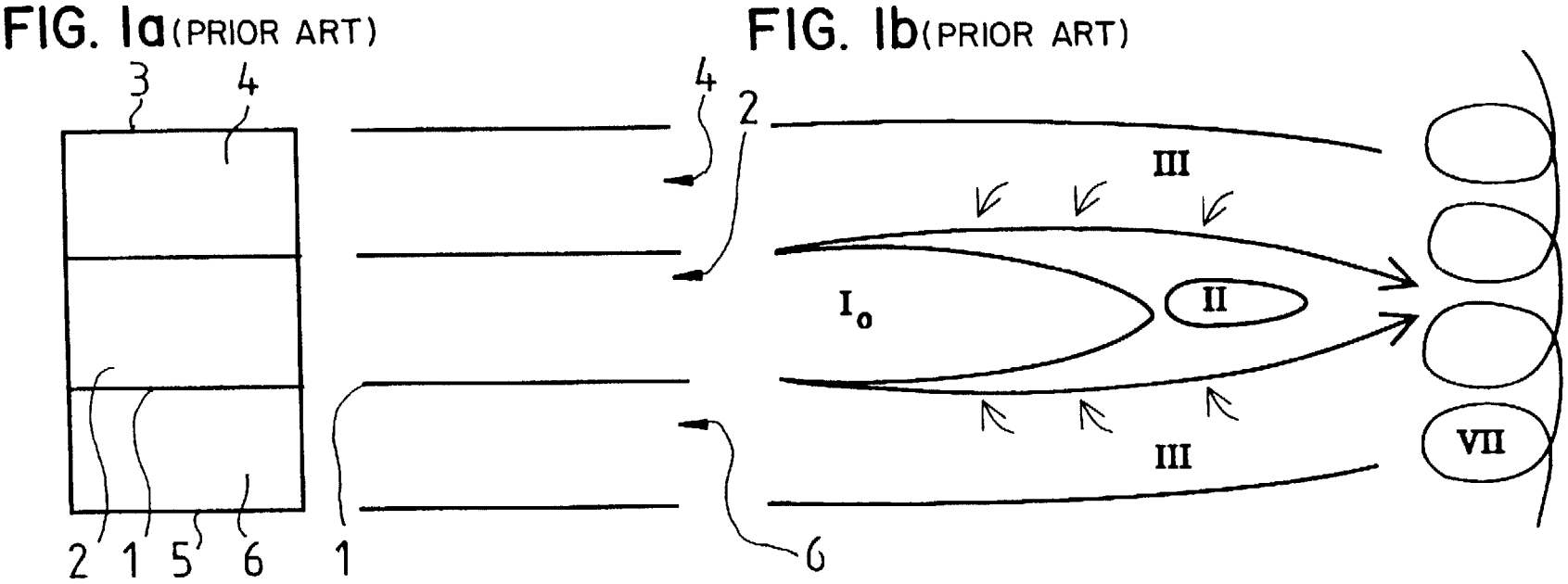
FIG. Ia (PRIOR ART)
FIG. Ib (PRIOR ART)
3
4
2
1
5
6
4
2
6
1
III
II
III
$I_o$
VII VII
IV
IV
III
II
V
V
I
I
I
$I_o$
2
20
8
17a
$\theta_3$
$\theta_4$
16
17
$d_3$
11
1
$d_2$
$d_1$
$h_1$
$h_2$
18
18a
15
13
7
14
12
8

VII
IV
IV
III
VI
II
VI
V
V
$I_o$
I
I
9b
8
9a
9
16
19
1
19
7
15
14
9a
7
13
12
8
11
1

METHOD AND APPARATUS FOR REDUCING NITROGEN OXIDE EMISSIONS FROM BURNING PULVERIZED FUEL

FIELD OF THE INVENTION

This invention relates to a method for burning pulverized fuel in a tangentially fired boiler and for creating reducing conditions in order to reduce nitrogen oxide emissions.

The invention also concerns an apparatus for implementing the method.

DESCRIPTION OF RELATED ART:

Today reducing harmful emissions in a power plant's exhaust gases has become one of the main objectives to developing modern combustion technologies and apparatures. Emissions of, for example, sulphur oxides and solids can be controlled to a great extent with modem technologies, but emissions of nitrogen oxides are still a problem that has not been entirely solved. It is well known that $NO_x$ formed in the combustion process is one of the main causes of air pollution; thus, certain basic improvements in burners or improvements in the whole combustion system have been made. A particular problem raised in the combustion of pulverized fuel is that organically bound nitrogen (nitrogen content is, for example, 1–2 wt % in coal and peat) is released to gas phase during the combustion process, generating large amounts a lot of NOx emissions.

During pyrolysis, the first stage of coal combustion, most of the fuel-N release to gas phase and gaseous compounds such as HCN and $NH_3$ occurs. After pyrolysis, smaller volumes of fuel-N are retained in the after pyrolysis progression to remaining solid particles, called "char-N". If, during this process, sufficiently oxygen is present, most of $NH_3$ and HCN is oxidized to $NO_x$. If the oxygen concentration is sufficiently low, these compounds tend to reduce to molecular $N_2$. It is also known that HCN and $NH_3$ can reduce the already formed $NO_x$, to molecular $N_2$ under the conditions of low oxygen content and high temperature.

Another fact is that some chemical radicals, especially $CH_i$ radicals, which are intermediate combustion products, can reduce $NO_x$. As a consequence, $NH_3$ and HCN are again formed, which can further reduce $NO_x$. With higher the temperatures and lower oxygen content, these reducing reactions are more liable to proceed. Accordingly, in order to suppress the generation of $NO_x$ during combustion of coal or other pulverized fuels, the technical problem is how to create such an atmosphere that has a suitably low oxygen concentration and high temperature.

In general, a combustion process referred to as two-stage combustion applies to this low-oxygen region for reducing the emissions of $NO_x$. In this process, an air-deficient zone is formed in the burner zone of a combustion furnace, and an amount of air corresponding to the above deficient amount of air is supplied through the so-called after-air port provided downstream of burners to effect complete combustion, whereby combustion over the whole of the combustion furnace is improved, thereby reducing the amount of $NO_x$ discharged. However, in case of a two-stage combustion like this, half-burned coal particles (char) are formed in the air-deficient zone of the burner, and a large free space is required in the furnace for complete combustion of the char with after-air. Thus, although the above combustion process (two-stage combustion) is rather efficient in lowering $NO_x$ emissions of the combustion, it has still certain limitations, such as creating unburned carbon and unstable flame conditions.

Thus, a new type low-$NO_x$ burner has been constructed so that the air-deficient zone is formed very close to the tip end of the burner, and the two-stage combustion is carried out by means of a single-burner. This single burner staging technique combined with staging in the whole furnace (OFA, Over Fire Air technique) is very efficient in lowering $NO_x$ emissions. The U.S. Pat. No. 4,545,307 describes this kind of a low-$NO_x$ burner. The burner described in the U.S. Pat. No. 4,545,307 is designed to be mounted perpendicularly in the wall of the furnace. These burners are equipped with a flame holder at the open end of the fuel feeding pipe, which promotes rapid ignition of the pulverized fuel; hence it is possible to allow a high temperature reducing zone to form near the burner. The flame holder is efficient also in reducing the amount of unburnt carbon, in addition to reducing $NO_x$ emissions. In these burners, pulverized fuel is fed with carrier air, amounting to 20 to 30% of the total combustion air passed through a coal pipe and injected through an injection port and flame holder into a combustion furnace. At the outer peripheral part of the burner, a stream of secondary air having a swirling motion imparted by air vanes is passed through a secondary air register. Further, in the outer peripheral part, a stream of tertiary air is passed through a tertiary air register, and it has a swirling motion imparted by a radial swirler. In order to achieve a low $NO_x$ concentration, it is necessary to separate the primary combustion zone from the secondary and tertiary air streams near the burner throat in order to form a good reducing atmosphere and, on the other hand, to enhance postflame mixing between unburnt carbon and tertiary air.

These modern low-$NO_x$ burners are intended to be mounted perpendicularly in the wall of a furnace (wall-fired boilers), and the flames are directed perpendicularly towards the center of the furnace. In wall-fired boilers there are several individual burners mounted next to each other, and all burners have their own separate flames. All these flames are stabilized and staged separately using burners with high-swirling motion for the combustion air. In the burners of the prior art (e.g. that of U.S. Pat. No. 4 545 307), staged combustion in air-deficient zones occurs in each flame separately, and the reducing zone is formed near the burner. The amounts of nitrogen oxides and unburnt carbon produced are therefore reduced.

In tangentially fired boilers, burners are located perpendicularly in each corner, and the flames and the combustion air are directed to the opposite corner to form a vortex in the center of the furnace. In case of the tangentially fired boilers, fuel and combustion air are injected axially into the boiler, and the final mixing occurs in the central vortex (fireball). The central vortex compensates for the lack of swirl of the combustion air and takes care of the flame stabilization. A tangential jet burner of the prior art typically comprises a fuel pipe, secondary air channel and sometimes an intermediate air channel for cooling materials between the fuel pipe and secondary air channel. Normally, using jet burners, the distance between the ignition point and the throat of the burner is 2–3 meters, and the burning of the fuel occurs mainly in the central vortex. Before the ignition point, the parallel streams of fuel and combustion air have been mixed together causing combustion in an oxidizing atmosphere and thereby forming $NO_x$ emissions. In case of two-stage combustion, an air-deficient reduction zone does not form until the central vortex, and no staging occurs in the fuel stream between the throat of the burner and the central vortex. The staging concerns only the central vortex flame, and deep staging comparable to the modern wall low-$NO_x$ burners can not be achieved by using jet burners.

The $NO_x$ emissions of existing tangentially fired boilers can be reduced by modifying the boiler and burners and installing an over fire air system (OFA), instead of totally new low-$NO_x$ burners. Normally this means that combustion is delayed. As a consequence, the amount of unburnt carbon increases, and only a moderate $NO_x$ reduction can be achieved. The U.S. Pat. No. 5 020 454 describes a firing system for tangentially fired boilers. This system includes a windbox and a first cluster of fuel nozzles mounted in the windbox for injecting clustered fuel into the furnace to create a first fuel-rich zone therewith, a second cluster of fuel nozzles mounted in the windbox for injecting clustered fuel into the furnace to create a second fuel-rich zone therewith, and an offset air nozzle mounted in the windbox for injecting offset air into the furnace and towards the walls of the furnace. The system also includes two sets of overfire air nozzles. With this system, fuel-rich zones are formed in the furnace and staged combustion occurs over the whole furnace. Emissions of nitrogen oxides are thereby reduced, but the system has several drawbacks. It is very complicated, and the furnace requires quite extensive modifications. No deep staging can be achieved, since the combustion air mixes rapidly with the fuel, and it is therefore difficult to maintain reducing conditions in the flame zone. In these modified boilers, staging occurs in the main vortex, instead of the primary combustion zone, because ignition is delayed.

As the requirements for controlling of nitrogen oxides in tangentially fired boilers are also growing, there is a need to improve better combustion methods and burners which can be fitted in existing tangentially fired boilers, too.

SUMMARY OF THE INVENTION

The object of this invention is to provide a totally new type of burner and a combustion method for reducing the emissions of nitrogen oxides in tangentially fired boilers.

Another object of this invention is to introduce a new method for reducing slagging problems of tangentially fired boilers, to reduce the amount of unburnt carbon and to improve flame stability.

The invention is based on controlling the air and fuel flows in burners of a tangentially fired boiler, whereby an air-deficient mixture of primary air and fuel is fed through a flame holder into the combustion chamber, and at least one stream of combustion air is routed around the stream of primary fuel into the central vortex so that the combustion air is essentially not mixed with the fuel until in the central vortex, and an air-deficient reducing zone is formed in the vicinity of the burner outlet.

According to one embodiment of the invention, a stream of secondary combustion air is passed around the flame formed of the fuel to provide a separating blanket of air around the flame, and a stream of tertiary combustion air is directed towards the water walls and horizontally away from the flame.

A burner according to this invention is called a NR-JET burner in the following.

The invention provides the following benefits.

The main object and advantage of this invention is a substantial reduction of emissions of nitrogen oxides in flue gases. By means of this invention, $NO_x$ emissions of tangentially fired boilers can be reduced at least to the same level as emissions of the modem wall fired boilers. The staging occurs both in a separate primary combustion zone in front of the burner and further in the main vortex with the overfire-air. With this new combustion method, a much deeper staging of the combustion can be achieved than in conventional tangentially fired boilers.

The slagging problem of tangentially fired boilers is avoided by directing air to the waterwalls, thereby providing an oxidizing atmosphere near the walls. The amount of unburnt carbon is reduced because of rapid ignition of the fuel, and, at the same time, flame stability is improved. The construction of the NR-JET burner is relatively simple. According to the invention, an application of the NR-JET burner is retrofitting old tangentially fired boilers. When an old boiler is retrofitted with these burners, $NO_x$ emissions are reduced remarkably, and combustion efficiency is improved.

This invention provides a totally new type of low-$NO_x$ burner for the tangentially fired boilers, i.e. the NR-JET burner, applying some of the above mentioned principles used in wall fired low-$NO_x$ burners. In a boiler which has been fitted with NR-JET burners, staging occurs both in the primary combustion zone in front of the burner and in the main vortex with OFA. In the NR-JET burner, pulverized fuel is injected by carrier air to the amount of about 20 to 30% of the total combustion air into the combustion furnace. Around the fuel pipe there is a concentric a secondary air channel, for injecting the secondary air into the furnace. In uppermost and lowermost parts of the burner there are tertiary air channels and representative injection ports. The fuel stream is separated from the tertiary air streams with spacers in order to form a good reducing atmosphere in the primary combustion zone. In addition to the spacers, both tertiary air injection ports are equipped with outwardly directed guide-sleeves, which direct the tertiary air streams vertically away from the primary combustion zone. Furthermore, the tertiary air can be directed horizontally away from the center of the furnace and towards the waterwalls. This way oxygen is kept on the waterwalls, and the lower furnace heat absorption is improved. This also prevents the tendency of high volumes of over-fire air to slag the lower furnace and to increase the furnace outlet temperature.

BRIEF DESCRIPTION OF THE DRAWINGS

Below, the invention is explained in detail with references to the enclosed drawings.

FIGS. 1*a* and 1*b* are is a schematic front and cross sectional view of the conventional Jet-burner for tangentially fired boilers, respectively.

Figure 2B:
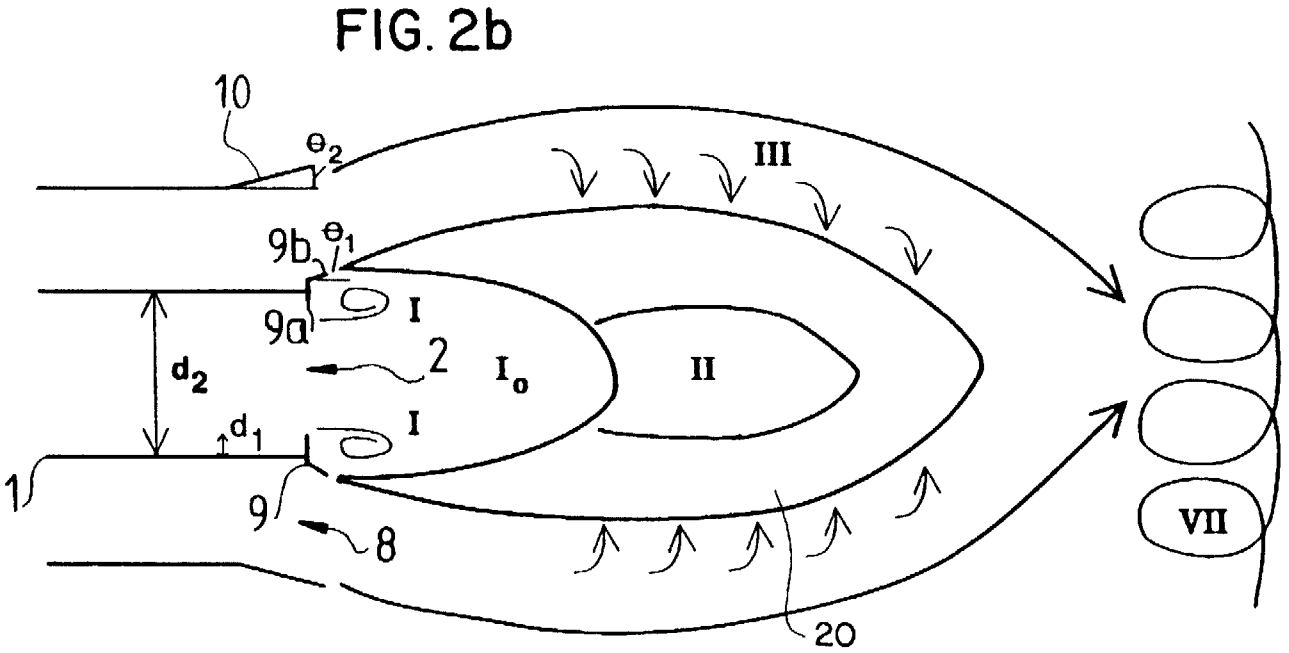
FIGS. 2*a* and 2*b* are is a schematic front and cross sectional view of one embodiment of the invention, respectively.

DETAILED DESCRIPTION OF A PREFERRED EMBODIMENT:

Basically, there are three versions of the burner according to the present invention, namely NR-JET 1, NR-JET 2 and NR-JET 3. All these NR-JET burners have basically the same functional idea, but the need for a different construction is based on the lack of space in the existing boilers/burner throats. NR-JET 3 burner has the best combustion performance and the lowest $NO_x$ emissions, but the burner throat diameter is the largest, limiting the applicability of this burner.

The preferred structure of the burner used for implementation of the invention is illustrated in FIGS. 2–5. FIGS. 1–4 also show the flame shape and the various combustion zones illustrating the combustion process.

In the figures, $I_o$ is the volatilization zone, I the primary recirculation zone, II the reducing zone, III the vigorous turbulent combustion zone, IV the tertiary recirculation zone, V the stagnation zone, VI the secondary recirculation zone and VII the main vortex.

A conventional jet-burner consists of rectangular pulverized coal pipe 1 and injection port 2 of the coal pipe. Around fuel pipe 1 there is upper secondary air channel 3 with upper secondary air injection port 4 and lower secondary air channel 5 with lower secondary air injection port 6. As it can be seen in the FIG. 1, reducing zone II is very small.

Figure 2A:
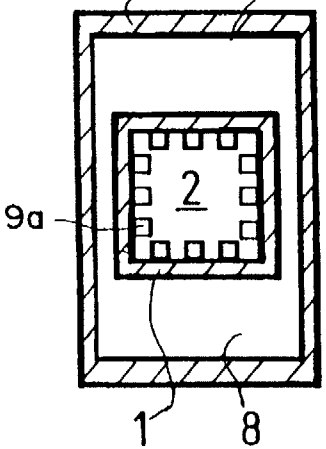

FIGS. 2*a* and 2*b* show NR-JET 1 burner according to the invention. The NR-JET comprises rectangular pipe 1 for pulverized fuel and injection port 2 in the outlet end of the fuel pipe 1. Around the fuel pipe there is concentrically arranged rectangular secondary air channel 7, forming a secondary air passageway around the outer periphery of pulverized fuel pipe 1, and injection port 8 for channel 7. NR-JET 1 burner is also equipped with flame holder 9, which comprises ring 9*a* inside coal pipe 1 and guide sleeve 9*b* in secondary air channel 7. Ring 9*a* has the same rectangular form as the cross section of injection port 2 of fuel pipe 1, and it extends perpendicularly towards the central axis of fuel pipe 1. The cross section of ring 9*a* may be a continuous ring, but in this construction ring 9*a* is provided with teeth, that extend into fuel pipe 1. Secondary air channel 7 surrounds the end part of coal pipe 1 and outward secondary air guide sleeve 9*b* of flame holder 9 extends into channel 7. In addition, the outer part of secondary air channel 7 of NR-JET 1 burner is provided with angled guide sleeve 10. The vertical outward angle of angled guide sleeve $\theta_2$ is typically between 5°–40° in relation to the central axis of the burner.

Flame holder 9 is a ring that surrounds the inner wall of fuel pipe 1, and it is made of, or coated by, a wear and heat-resistant material such as ceramics or heat-resistant steel. In this construction, flame holder 9 is a rectangular or cylindrical bluff body having a hole through which the pulverized coal stream is passed in the central part thereof, and it is arranged in the opening end of fuel pipe 1. The inner side of the flame holder, ring 9*a*, extends nearly perpendicularly to the axial direction of fuel pipe 1, and the secondary air guide sleeve 9*b* thereof being formed either in parallel to the axial direction of the pulverized coal pipe toward the combustion furnace or at such an angle that the diameter of the guide sleeve is enlarged to the radial direction of secondary air channel 7. Furthermore, in order to enhance ignitability at the exit of the injection port of fuel pipe 1, and to generate the high temperature reducing flame at the exit end with certainty, ring 9*a* forms a toothed apron protruding at the inner peripheral surface of the fuel pipe 1 at the exit of injection port 2 thereof towards the center of fuel pipe 1 to ensure efficiency of the present invention. The apron may be a continuous ring, but in this embodiment it is serrated, i.e. provided with cut-away parts in it. The inner diameter or dimension $d_1$ of ring 9*a* of flame holder 9 and inner diameter $d_2$ of fuel pipe 1 are preferably determined to satisfy a relation of $0.7 \leqq (d_1/d_2) \leqq 0.98$, and most preferably determined so as to give a $d_1/d_2$ of about 0.9. The ratio of $d_1/d_2$ is not limited to the above range, but if the ratio of $d_1/d_2$ is too low, the flame holder protrudes too much into fuel pipe 1, increasing the flow rate of the pulverized coal stream passing through the injection port, and hence increasing the pressure drop inside the fuel feeding pipe.

Angle $\theta_1$ formed between angled secondary air guide sleeve 9*b* and central axis of the fuel pipe is typically between 15°–25° in order to give enough flame maintenance effect and to separate well the central reducing flame from the oxidizing main flame and the combustion air.

NR-JET 2 burner comprises rectangular fuel pipe 1 having injection port 2. Around the fuel pipe there is concentrically arranged rectangular secondary air channel 7 Forming a secondary air passageway around the outer periphery of fuel pipe 1, and injection port 8 of channel 7. In the uppermost and lowermost parts of the burner there is upper tertiary air channel 11 and lower tertiary air channel 13, and corresponding injection ports 12 and 14. Between tertiary air channel II and secondary air channel 7 there is upper spacer 16 and between lower tertiary air channel 13 and secondary air channel 7 there is lower spacer 15. The primary function of the spacers is to separate the secondary and the tertiary air streams in order to protect the formation of reduction zone II in front of the burner. The height ($d_3$) of spacers 15, 16 varies normally between 30 and 350 mm. Flame holder 9 is similar to that in NR-JET 1 burner.

Figures 3A, 3B:
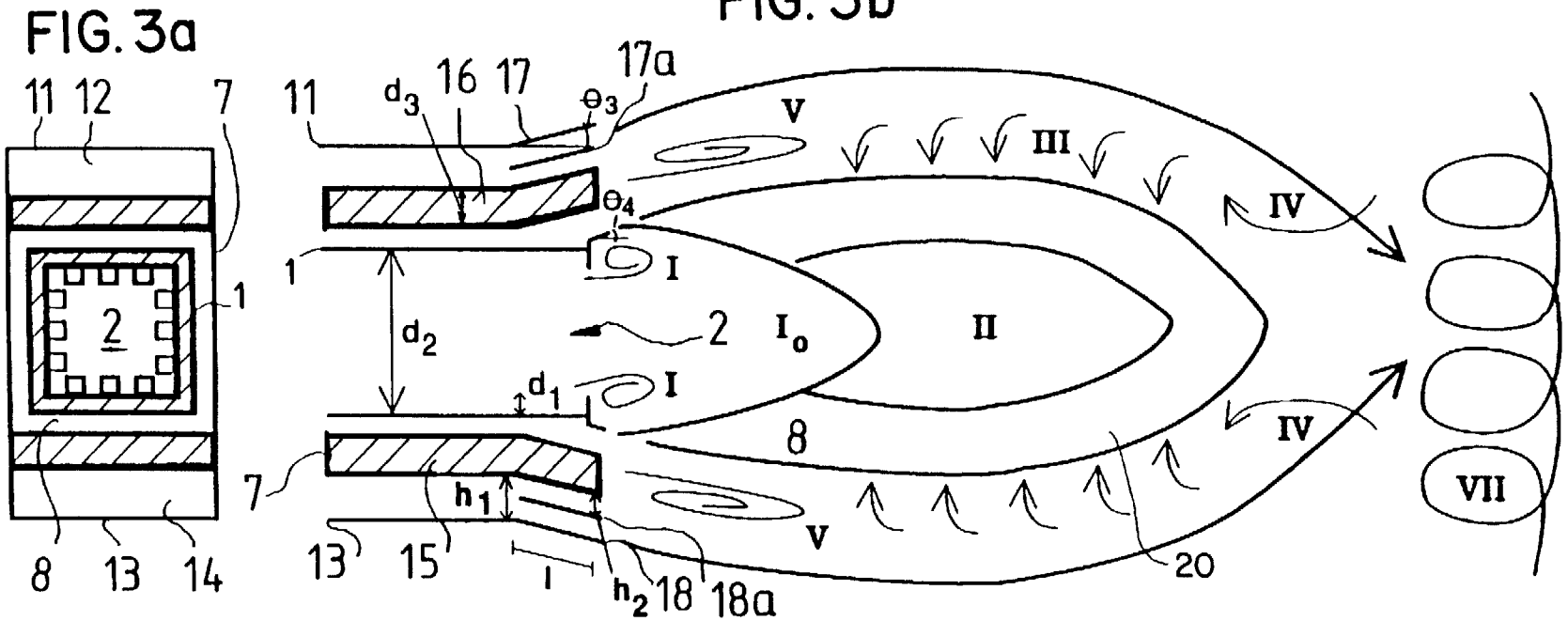
FIGS. 3*a* and 3*b* are is a schematic front and cross sectional view of the second embodiment of the invention, respectively.
Figures 4A, 4B:
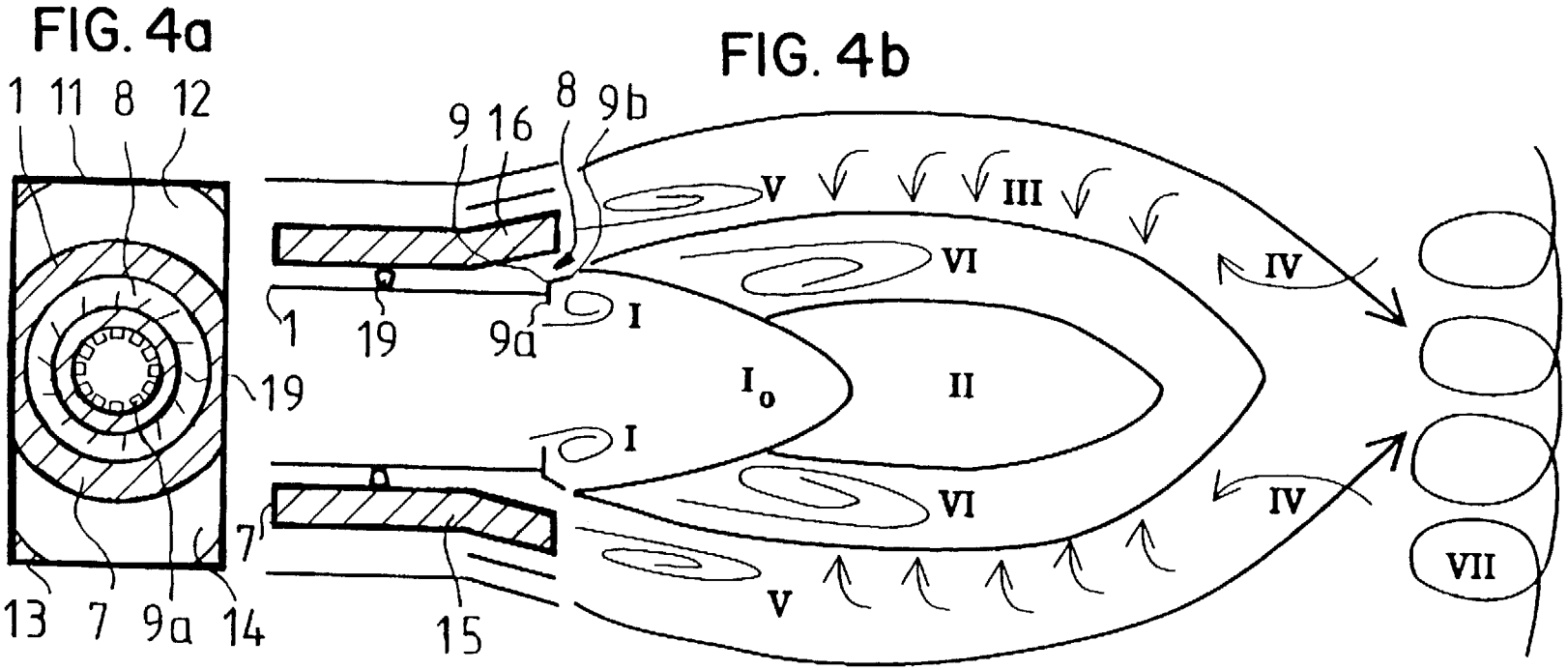
FIGS. 4*a* and 4*b* are is a schematic front and cross sectional view of the third embodiment of the invention, respectively.

Both upper and lower tertiary air channels 11 and 13 are also equipped with guide sleeves 17 and 18 having vertical angle $\theta_3$. Normally $\theta_0$ is between 5° and 40°. In order to achieve sufficiently good funnel like effect for tertiary air in the tertiary air injection ports 12, 14, the length of the sleeves should be designed so that the relation between the length of sleeve I and the height of the tertiary air passage $h_1$ is $1/h_1 \geqq 2$ (FIG. 3.). It is possible to shorten the length of the sleeves by using intermediate guide sleeves 17*a* and 18*a* without losing the funnel like effect, but then the sleeves should be designed so that the relation between length 1 of the sleeves and height $h_2$ of the channel formed between the intermediate guide sleeve and the wall of the air channel is $1/h_2 \geqq 2$.

Tangential jet burner NR-JET 3 is basically similar to NR-JET 2 burner, with the exception of air vanes 19 being provided in the passageway of secondary air channel 7. These axial vanes 19 give the secondary air stream a tangential velocity component improving the turbulent combustion near the burner throat. Typically the number of air vanes 19 is 8–15, and the vanes are angled to the axial direction in an angle of 40°–50° so that swirl number is between 0.5 and 1.0. Another difference between NR-JET 2 and NR-JET 3 is the shape of the fuel pipe and the air channels.

Fuel pipe 1, fuel injection port 2, secondary air channel 7 and secondary air injection port 8 have a cylindrical shape and, as earlier, they are equipped with flame holder 9, which comprises angled secondary air guide sleeve 9*b*, and toothed ring 9*a* . Flame holder 9, spacers 15, 16, tertiary air channels 11, 13 and tertiary air injection ports 12, 14 are cylindrically shaped.

The amount of primary air depends basically on the mill conditions, being typically between 20 and 30%. Favorable velocity of the primary air is 15–25 m/s.

According to the invention, one object of the secondary air is to prevent spreading of the coal/primary air stream. The secondary air is passed around the reducing flame II with a great velocity, and it forms a separating blanket 20 reducing the amount of coal particles that are driven to the furnace walls, and the slagging behavior of the boiler is reduced. In addition, the amount of primary and secondary air should enable the burning of the volatile material of the fuel. Thus, the percentage of volatiles in the coal or other fuels determines the amount of the secondary air, being normally less than 30%. In order to achieve a sufficient enveloping effect and proper mixing of the secondary air and the primary air/fuel mixture, the velocity of the secondary air has to be sufficiently high, about 30–80 m/s. The rest of the combustion air is injected through the tertiary air injection ports, and the mass flow ratio between secondary and tertiary air is 1:2–1:5. The velocity of the tertiary air at the tertiary air injection port is 30–80 m/s. If the content of volatiles in the fuel is low, the amount of primary air may be sufficient for combusting these volatiles in the reducing flame. In such case, mixing of secondary air with the reducing flame must be prevented. In this embodiment, the secondary air flow is similar to the tertiary air flow, and no separate secondary air streams exists unlike in NR-JET 2 and 3 burners. In this case, the combustion air channel may surround the primary air/fuel channel, or it may be arranged in two separate channels above and below the fuel pipe.

Another very important fact concerns flame stabilization and mixing: in case of swirling burners, tertiary air has high swirl number that gives good postflame mixing and stabilization. In case of tangential NR-JET burner, tertiary air has only axial momentum, but in this case central vortex compensates the lack of the swirl and takes care of mixing and flame stabilization In case of the conventional jet burner (axial flows, no swirl, FIG. 1), ignition point is far from fuel pipe, volatilization $I_o$ zone is large, flame is unstable and there will be no reducing zone II, or it is very small, which results in high NOx emissions. Actual flame stabilization in tangentially fired boilers using the conventional jet burners occurs in main vortex zone VII. Turbulent/oxidizing combustion zone III occurs on the outer boundary layer of the primary air flow and in main vortex.

NR-JET 1 burner is equipped with flame holder 9, which enhances the formation of primary recirculation zone I improving ignition and flame stability. The secondary air is passed around the primary air and fuel with a great velocity, and this prevents spreading of the fuel stream. The passage for secondary air 8 is shaped to direct a part of the secondary air away (ring 9*a*+ sleeve 9*b*, θ2) from the primary air and fuel.

As a result, reducing zone II is larger and nearer the burner throat than in the conventional jet burner.

In the same way as NR-JET 1 burner, NR-JET 2 burner is equipped with flame holder 9, which enhances the formation of primary recirculation zone I improving ignition and flame stability. The ignition and flame stability of NR-JET 2 burner is improved compared to NR-JET 1 burner thanks to the tertiary recirculation zone IV. This is a consequence of the underpressure zone formed between secondary and tertiary air streams, whereby hot flue gases from the main vortex are recirculated back to the combustion zone. In addition, less secondary air is mixed into the volatilization zone avoiding the dilution effect and enhancing the ignition and flame stability, compared to NR-JET 1 burner. Because of these effects, the volatilization occurs more rapidly and the volatilization zone is smaller. In front of both spacers, is formed stagnation zone V that prevents efficiently mixing of the tertiary air into reduction zone II, so it does not disturbe the formation of reducing conditions. The length of the spacers ($d_3$) determines the horizontal length of stagnation zone V, so the longer the $d_3$, the better the stagnation zone and the better the $NO_x$ reduction. Besides the spacers, tertiary air guide sleeves 17, 18 prevent mixing of tertiary air into reduction zone II, because the sleeves direct tertiary air away from the primary combustion zone. The upper tertiary air injection port is directed upwards, and the lower one accordingly downwards from the primary combustion zone to prevent mixing into the flame until the central vortex (fireball), wherein the final oxidation of the fuel occurs.

Figure 6:
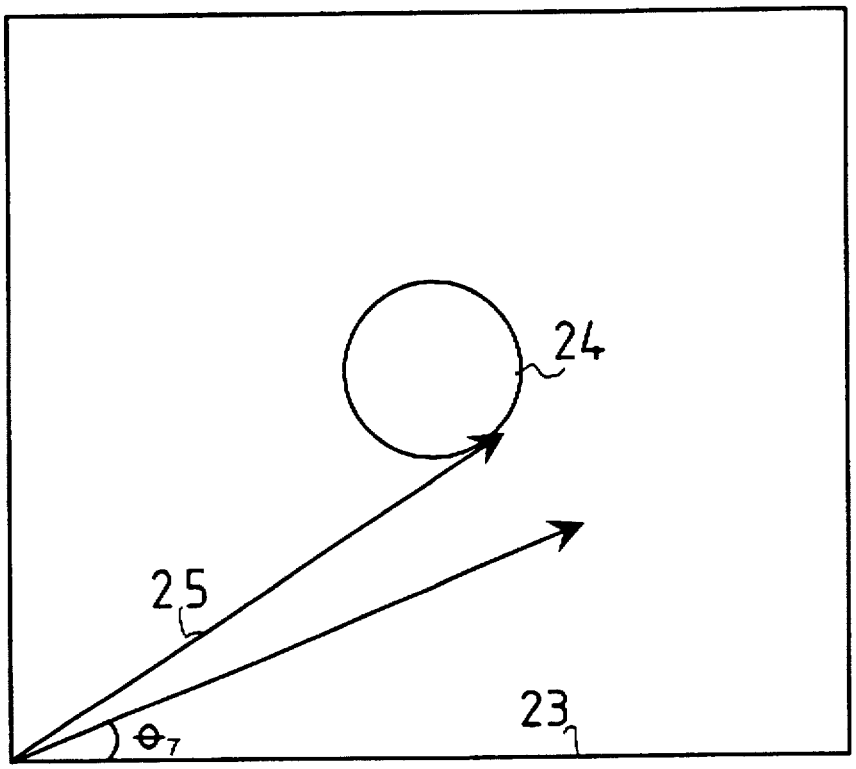
FIG. 6 is a schematic view of the principle of directing the jet of the tertiary air horizontally to the direction of the water wall. In the figure the angles are just an illustrating example.

In addition to directing tertiary air injection ports 12 and 14 upwards and downwards, they are shaped to direct the tertiary air away from the center of the furnace and towards water walls 23 of the furnace (FIG. 6). By this means, oxygen is kept away from the centre of the furnace and near water walls 23 so as to prevent reducing atmosphere to form there. The slagging of the lower furnace is also reduced, and the lower furnace heat absorption is increased. Angle $\theta_7$ between tertiary air flow 26 and wall 23 is preferably 5°–45°, and the guide sleeves in the tertiary air passages are arranged accordingly. FIG. 6 also shows fuel flow 25 from the comer of the furnace to central vortex 24, where the fuel finally bums.

As a result of spacers and separated secondary and tertiary air, reducing zone II in NR-JET 2 burner is larger than in conventional jet-burner and the NR-JET 1 burner.

Figure 5:
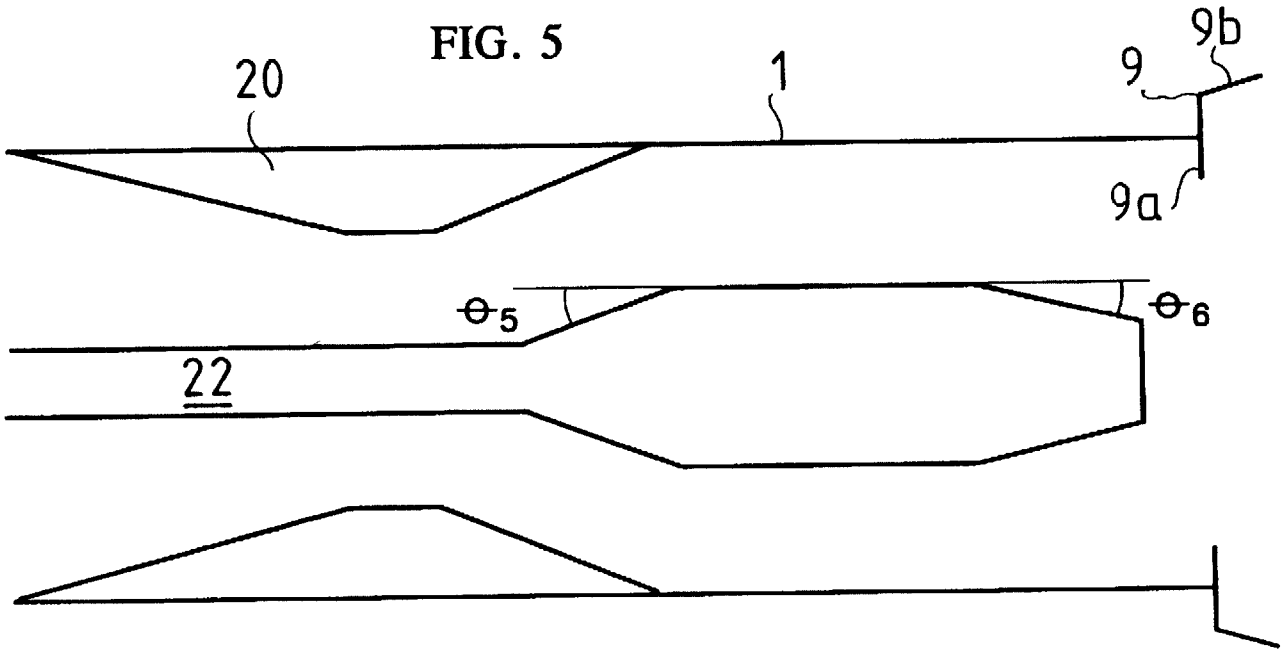
FIG. 5 is a schematic view of the fourth embodiment of the invention.

NR-JET 3 burner is similar to NR-JET 2 burner, but fuel pipe 1, the secondary air channel 7 and secondary air injection port 8 are of round shape. Because of its shape, it is possible to equip secondary air channel 7 with an axial swirler. Swirl number is between 0.5 and 1.0. Because of the secondary air swirl, secondary air recirculation zone VI is formed between the primary air and tertiary air jets creating a hot spot, and heat transfer to the primary combustion zone is increased. This improves flame stabilization, and volatilization occurs more rapidly, and a larger reduction zone is formed. With this configuration, it is possible to achieve both the lowest amount of unburnt carbon (rapid ignition) and the lowest $NO_x$ emissions (large reduction zone). In case of NR-JET 1,2 and 3 burner, it is possible to apply inside fuel pipe 1 venturi part 20 and pulverized fuel concentrator (P.F. concentrator) part 22. This kind of fuel pipe is shown in FIG. 5. Venturi 20 is located at a distance from the exit end of fuel pipe 1, and the concentrator extends through the throat of venturi 20. The dimensions of concentrator 22 start to enlarge at the same time as the inner diameter of fuel pipe 1 starts to enlarge after venturi 20. The dimensions of concentrator 22 start to diminish near the exit of pipe 1, and concentrator 22 ends in the vicinity of flame holder 9. With venturi 20 it is possible to achieve more uniform fuel particle distribution before P.F. concentrator 22. To improve the ignition, increasing concentration of pulverized fuel around the flame holder, the flame stabilization is the most effective. In a two-phase flow of gas and particles, if the path is expanded, unhomogenous concentration will be formed due to difference of momentum between gas and particles, so P.F. concentrator is used. The fuel concentrator is arranged on the centerline of the fuel pipe and has a bulge part forming an angle of 5°–60° ($\theta_5$) at the leading side of the fuel stream, and an angle of 5°–30° ($\theta_6$)at the exit side of the fuel stream.

We claim:

1. A method for combusting a pulverized fuel in a tangentially fired boiler, thereby reducing emission of nitrogen oxides, comprising the steps of:

feeding a substantially air-deficient mixture of pulverized fuel and primary air as a stream through a fuel feeding pipe tangentially into a furnace of the tangentially fired boiler in order to feed a reducing flame, and directing at least one stream of combustion air into the furnace, wherein the stream of primary air and fuel is caused to recirculate and turbulate at an open end of the fuel feeding pipe by passing it through a flame holder extending into the fuel feeding pipe, wherein the at least one stream of combustion air is directed axially in relation to the primary air/fuel stream and away from the primary air/fuel stream in order to delay the mixing of the at least one stream of combustion air and the reducing flame.

2. The method according to claim 1, wherein said step of directing at least one stream of combustion air comprises directing a stream of combustion air into the furnace circumferentially around the primary air/fuel stream, so as to envelop the primary air/fuel stream and be directed away from the stream of air/fuel mixture, thereby forming a separating envelope around the reducing flame.

3. The method according to claim 2, wherein the stream of combustion air has a velocity of 30–80 m/s.

4. The method according to claim 1, wherein the stream of primary air has a velocity of 15–25 m/s.

5. The method according to claim 1, wherein said step of directing at least one stream of combustion air into the furnace comprises directing a stream of upper combustion air into the furnace above a central axis of the fuel feeding pipe and a stream of lower combustion air below the central axis of the fuel feeding pipe in order to further combust the fuel, wherein the streams of upper and lower combustion air are are spaced away from the stream of primary air and fuel, and are respectively directed upwardly and downwardly away from the stream of primary air and fuel.

6. The method according to claim 1, wherein said step of directing at least one stream of combustion air into the furnace comprises:

directing a stream of secondary combustion air into the furnace circumferentially around and away from the primary air/fuel stream, so that the stream of secondary combustion air envelops the primary air/fuel stream to form a separating envelope around the reducing flame, and directing streams of upper and lower tertiary combustion air into the furnace which are spaced from the stream of secondary combustion air, wherein the streams of upper and lower tertiary combustion air are respectively directed upwardly and downwardly away from the stream of fuel and primary air.

7. The method according to claim 6, wherein the streams of upper and lower tertiary combustion air are also directed laterally away from the stream of the secondary combustion air.

8. The method according to claim 6, comprising a step of causing the secondary combustion air to circulate around the stream of fuel and primary air.

9. The method according to claim 8, wherein the secondary combustion air is caused to circulate around the stream of fuel and primary air with a swirl number between 0.5 and 1.0.

10. An apparatus for combusting a pulverized fuel in a tangentially fired boiler so as to reduce emissions of nitrogen oxides, comprising:

a central fuel pipe for tangentially feeding the fuel together with an air stream into a furnace of the boiler so as to feed a reducing flame, at least one combustion air channel provided adjacent to said fuel pipe for feeding a stream of combustion air into the furnace, a flame holder arranged at an end of said fuel pipe and extending inwardly into said fuel pipe, said flame holder having a hole through which the air/fuel mixture is fed into the furnace, wherein, at the open end of said at least one combustion air channel are arranged means for directing at least one combustion air stream to flow axially in relation to the air/fuel mixture and away from the air/fuel mixture in order to delay mixing of the at least one combustion air stream and the reducing flame.

11. The apparatus according to claim 10, wherein said at least one combustion air channel is arranged circumferentially around said fuel pipe, whereby the at least one combustion air stream is fed around the air/fuel mixture as to envelop the air/fuel mixture and form a separating envelope around the reducing flame.

12. The apparatus according to claim 10, said at least one combustion air channel comprises:

an upper channel for feeding a stream of upper combustion air into the furnace above said fuel feeding pipe, and a lower channel for feeding a stream of lower combustion air below said fuel feeding pipe in order to further combust the fuel, wherein open ends of said upper and lower channels are spaced from the stream of the fuel/air mixture and said upper and lower channels include at their respective open ends means for directing the streams of upper and lower combustion air, respectively, upwardly and downwardly away from the stream of the fuel/air mixture.

13. The apparatus according to claim 10, further comprising:

a secondary combustion air channel arranged circumferentially around said fuel pipe, so that a stream of secondary combustion air is fed around the fuel/air stream to enable the stream of combustion air to envelop the fuel/air stream and form a separating envelope around the reducing flame, and upper and lower tertiary combustion air channels for upper and lower tertiary air spaced from the exit location of the stream of the fuel/air mixture, said upper and lower channels including at their respective open ends means for directing the upper and lower streams of tertiary combustion air, respectively, upwardly and downwardly away from the fuel/air stream.

14. The apparatus according to claim 13, wherein said means for directing the upper and lower tertiary air streams comprise guide sleeves arranged at respective ends of said upper and lower tertiary combustion air channels at an angle of between 5° and 40° in relation to a central axis of said central fuel pipe.

15. The apparatus according to claim 14, wherein a length of one said guide sleeve divided by a height of one said tertiary air channel is at least about 2.

16. The apparatus according to claim 14, further comprising intermediate guide sleeves within provided within said upper and lower tertiary combustion air channel channels, wherein a length of one said intermediate guide sleeve divided by a height of a space between said one intermediate guide sleeve and a wall of one of said tertiary air channels is at least about 2.

17. The apparatus according to claim 10, wherein said flame holder includes an angled guide sleeve arranged at an end of said secondary combustion air channel at an angle of between 15° and 25° in relation to a central axis of said central fuel pipe.

18. The apparatus according to claim 10, wherein said flame holder comprises a toothed ring extending into said central fuel pipe.

19. The apparatus according to claim 10, further comprising:

a venturi throat inside said central fuel pipe; and a fuel concentrator arranged on a centerline of said central fuel pipe, said fuel concentrator having a bulged part forming an angle of 5°–60° at a leading side of the fuel/air stream, and an angle of 5°–30° at an exit side of the fuel/air stream.

20. The apparatus according to claim 11, wherein said at least one combustion air channel comprises:

an upper channel for feeding a stream of upper combustion air into the furnace above said fuel feeding pipe, and a lower channel for feeding a stream of lower combustion air below said fuel feeding pipe in order to further combust the fuel, wherein open ends of said upper and lower channels are spaced from the stream of the fuel/air mixture and said upper and lower channels include at their respective open ends means for directing the streams of upper and lower combustion air, respectively, upwardly and downwardly away from the stream of the fuel/air mixture.

* * * * *